US006662984B2

(12) United States Patent
Mor

(10) Patent No.: US 6,662,984 B2
(45) Date of Patent: Dec. 16, 2003

(54) CARRYING DEVICE FOR PHOTOGRAPHIC EQUIPMENT AND THE LIKE

(76) Inventor: Avichay Mor, 89 Yahalom Street, Shaarei Tikva 44810 (IL)

( * ) Notice: Subject to any disclaimer, the term of this patent is extended or adjusted under 35 U.S.C. 154(b) by 48 days.

(21) Appl. No.: 10/012,492

(22) Filed: Dec. 12, 2001

(65) Prior Publication Data

US 2003/0075577 A1 Apr. 24, 2003

(30) Foreign Application Priority Data

Oct. 18, 2001 (IL) ..... 146030

(51) Int. Cl.[7] ..... A45F 3/04

(52) U.S. Cl. ..... 224/576; 224/266; 224/647; 224/908; 224/909

(58) Field of Search ..... 224/265, 266, 224/576, 580, 647, 908, 909, 153, 578

(56) References Cited

U.S. PATENT DOCUMENTS

| | | | | | |
|---|---|---|---|---|---|
| 2,643,803 | A | | 6/1953 | Bates | |
| 3,602,409 | A | | 8/1971 | Kerns | |
| 3,884,403 | A | * | 5/1975 | Brewer | 224/5 V |
| 4,033,488 | A | * | 7/1977 | Brewer | 224/5 V |
| 4,091,974 | A | | 5/1978 | McClintock | |
| 4,125,211 | A | | 11/1978 | Handsman | |
| 4,561,576 | A | | 12/1985 | Lowe et al. | |
| 5,323,942 | A | | 6/1994 | Dahan | |
| 5,440,761 | A | | 8/1995 | Abrams et al. | |
| 5,586,699 | A | * | 12/1996 | Heisler et al. | 226/628 |
| 5,603,545 | A | | 2/1997 | Benson et al. | |
| 5,657,917 | A | | 8/1997 | Johnson et al. | |
| 5,862,967 | A | * | 1/1999 | Johnson | 224/577 |
| 6,216,932 | B1 | * | 4/2001 | Wu | 224/583 |
| 6,460,746 | B1 | * | 10/2002 | Amram | 224/579 |
| 2002/0043544 | A1 | * | 4/2002 | Caneba | |
| 2002/0145028 | A1 | * | 10/2002 | Moore | |

FOREIGN PATENT DOCUMENTS

| | | | |
|---|---|---|---|
| DE | 4000493 A1 | * | 7/1991 |
| JP | 20004918 A | * | 1/2000 |

* cited by examiner

*Primary Examiner*—Sue A. Weaver
(74) *Attorney, Agent, or Firm*—Birch, Stewart, Kolasch & Birch, LLP

(57) ABSTRACT

A carrying device comprising a rigid elongate yoke, extending between two distal ends, a clamping member adapted for engagement with the yoke member to clampingly fix the device on a supportive member of a backpack. At least both ends of the yoke member laterally project from the supportive member and each of the ends is formed with at least one strap-engaging element for connecting thereto a strap to support equipment. When the backpack is carried over the shoulders of a wearer, the equipment/gear hangs down in front of the body of the wearer.

24 Claims, 4 Drawing Sheets

CARRYING DEVICE FOR PHOTOGRAPHIC EQUIPMENT AND THE LIKE

FIELD OF THE INVENTION

The present invention is in the field of carrying devices, in particular for carrying equipment hanging down in front of the body of the wearer (suspended over the chest), e.g. photographic and video equipment, binoculars, rangefinders, etc. More particularly, the invention is concerned with a device which reduces the load and burden from the individual's neck while carrying such equipment.

BACKGROUND OF THE INVENTION

It is often a requirement to carry equipment in a readily accessible and operable position. Such equipment is, for example, photographic and video equipment, binoculars, compass, navigating equipment, etc.

Traditionally, such equipment is carried by neck straps such that the equipment is indeed readily accessible and easily brought into eyesight at demand.

This however, is at times extremely uncomfortable, in particular when the equipment is heavy and carried for long duration of time. Even more so, the problem becomes worse when several such articles of equipment are to be carried, where at times a person may have mounted around his neck several straps which are both cumbersome and uncomfortable. In some emergency situations this arrangement may be even hazardous.

Various solutions have been proposed for dealing with these problems. For example, U.S. Pat. No. 2,643,803 is directed to a supporting strap for cameras or binoculars and in fact comprises a pair of back straps secured to a torso strap extending under the armpits of the user and a hold-down strap for connecting to a belt of the user, where the binoculars are secured to the back straps by means of elastic cords.

U.S. Pat. No. 3,602,409 is directed to a camera harness including a neck band having spaced D-rings embedded in each end, and three pairs of straps having swivel spring closed hooks at both ends depending from the D-rings at each pair, adapted for supporting a camera at different levels over the wearer's chest.

U.S. Pat. No. 4,091,974 discloses a camera harness provided with a collar strap arranged around the back of the neck of the wearer and an elastic strap passing under the armpits with suitable arranging devices, such as D-rings, mounted on the collar strap for supporting camera equipment from suitable support straps connected to the D-rings.

U.S. Pat. No. 4,125,211 discloses an article supporting strap for supporting one or more cameras hanging down in front of the body of the wearer, where said strap extends downward behind the shoulders of the wearer and is connected with a stretchable or elastic part of the strap to a trouser band or belt.

U.S. Pat. No. 4,561,576 is concerned with a video equipment bag fitted with carrying handles, a shoulder harness that can be used with a camera harness attachable to the shoulder harness and a removable back strap so that the bag can be carried by hand, mounted as a backpack or carried as a shoulder bag depending upon the use then desired.

U.S. Pat. No. 5,323,942 discloses a carrying pack for photographic and similar equipment having a padded vest covering the chest of the user and secured to the user by detachable belt and straps extending to a lumbar member. The photographic equipment is secured to the shoulder area of the pack by floating adjustable straps. The pack is optionally provided with a weather cover to cover the equipment when not in use.

U.S. Pat. No. 5,440,761 is concerned with a multi-pocketed photographer's vest which amongst others, comprises one or more pairs of straps extending from the should area of the vest for supporting photographic equipment.

U.S. Pat. No. 5,603,545 refers to a universal strap having an adjustable length which may be easily manipulated to tighten around an object to be carried and then may be easily loosened up when the object is then laid down.

U.S. Pat. No. 5,657,917 is directed to a slipover carrying device for use by a wearer to carry possessions on the wearer's back and comprising a movable pouch supported adjacent a back panel of the device which pouch is attached in a position such that it is graspable by the wearer for moving it between a back and front position, respectively.

It is an object of the present invention to provide a novel carrying device for use in conjunction with a backpack fitted at least with a pair of back straps (at times referred to as shoulder straps) and wherein the user is not compelled to wear an additional harness or similar device. Rather, the device is engaged with the backpack and the equipment to be suspend down in front of the body of the wearer's chest is linked by suitable straps to said device.

SUMMARY OF THE INVENTION

The invention provides a carrying device for supporting articles over a person's chest while wearing a backpack, such that the load of the articles is in fact transferred to the back straps of the backpack, thus borne by the user's shoulders. The device in accordance with the present invention is modular for attachment at several locations of a typical backpack and may easily be removed from one backpack to another or stored. An important feature of the invention is that it does not interfere with the normal function and operation of the backpack.

In accordance with the present invention there is provided an elongate yoke member made of rigid material extending between two ends thereof, and a clamping member adapted for engagement with the yoke member so as to clampingly fix the device on a supportive member of a backpack; and where at least both ends of the yoke member laterally project from said supportive member; each of said ends is formed with at least one strap-engaging element for connecting thereto a strap to support equipment. When the backpack is then carried over the shoulders of a wearer, the equipment/gear hangs down in front of the body of the wearer.

The term "supportive member" or "supportive portion" denotes any of three possible locations of a backpack, namely a pair of back straps of the backpack, a carrying handle fitted at the top of the backpack adapted for carrying the backpack by hand and a flap-type cover of a backpack, typically a top such cover.

Preferably the yoke member spans longer than the neck width of an adult individual. In accordance with one embodiment, one of the yoke member and the clamping member is formed with an indented portion extending at least the span of the flap of a backpack, where in accordance with one particular embodiment, the indented portion is in the range of between about 15 cm to 30 cm.

In accordance with one embodiment, the yoke member is engaged with the clamping member by at least a pair of fastening members fitted adjacent the ends of the clamping member. Optionally, the yoke member is engaged with the clamping member by a centrally positioned bolt, whereby the device is configured to be attached to a carrying handle of the backpack. Typically but not necessarily, the fastening members are bolts. In accordance with other embodiments, the fastening members are clamps.

The invention is also concerned with a carrying system comprising a backpack formed with at least one supportive portion and at least one carrying device as defined by the present invention, with at least a pair of straps associated with each of the at least one carrying device and attached to the strap-engaging elements for suspending over the shoulders of the individual and articulating thereto the gear.

According to a feature of the invention, the straps are fitted at their end with quick-release type fasteners engageable with the equipment or corresponding straps attached thereto. By one embodiment of the invention, one strap is fitted with a male-component and the other strap is fitted with a female-component of the quick-release fastener, thereby being engageable with one another.

In order to prevent the gear suspended from the straps to dangle freely, the straps supporting the gear are engageable with the back straps of the backpack. This may be for example by providing a Velcro™ fastener or a hook, etc.

BRIEF DESCRIPTION OF THE DRAWINGS

In order to understand the invention and to see how it may be carried out in practice, some embodiments of the invention will now be described, by way of non-limiting examples only, with reference to the accompanying drawings, in which:

FIG. 7 is still another embodiment of a carrying device in accordance with the present invention, wherein:

DETAILED DESCRIPTION OF SPECIFIC EMBODIMENTS

Figure 1:
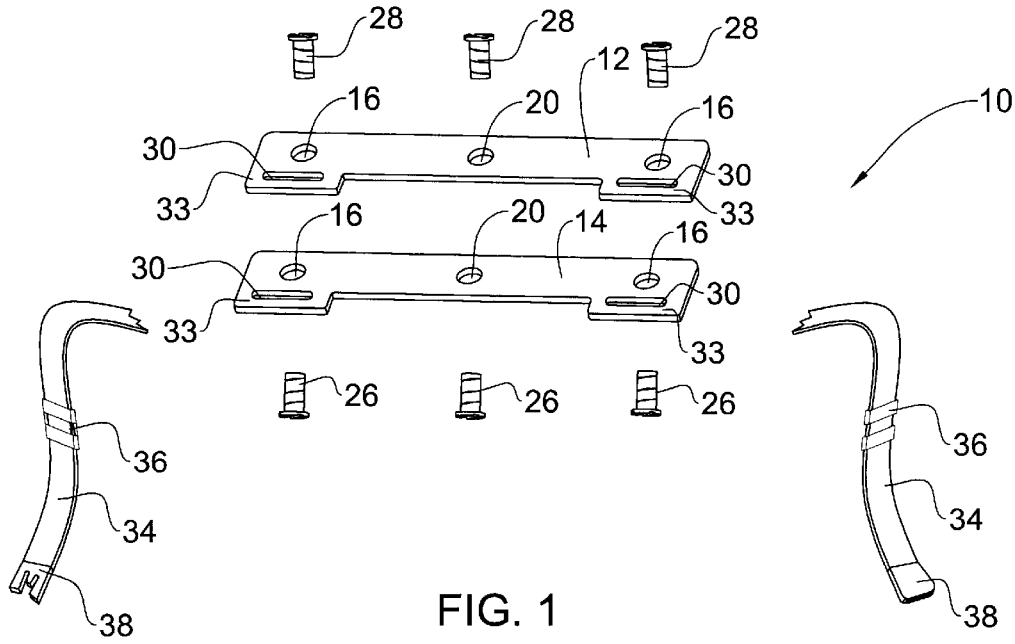
FIG. 1 is an isometric, exploded view of a carrying device in accordance with an embodiment of the present invention.

Turning first to the embodiment of FIG. 1, there is illustrated a first embodiment of a carrying device according to the present invention generally designated 10, comprising a yoke member 12 and a corresponding clamping member 14, both made of rigid material, e.g., polycarbonate, light metal, etc.

Yoke member 12 and clamping member 14 are each formed with three through going bores, of which two bores 16 are formed adjacent ends thereof, there is one central bore 20, and two bores 21 disposed intermediate. Additional bores/holes may be provided, to correspond with different widths of carrying handles.

The arrangement is such that the yoke member 12 and the clamping member 14 may be clampingly fixed to one another by screws/bolts 26 and nuts 28.

It is further noted that yoke member 12 and clamping member 14 are formed with indented portions 32, giving rise to projecting portions 33 at the ends of the yoke member.

Yoke member 12 is formed adjacent each of its ends with strap receiving slits 30. Each of the slits 30 is suitable for receiving a strap 34 fitted with a length adjusting buckle 36 and, the free end of the straps is fitted with a quick release fastener male-component 38 (left-hand side) and a quick release fastener female-component 40 (right-hand side), respectively.

Figure 2:
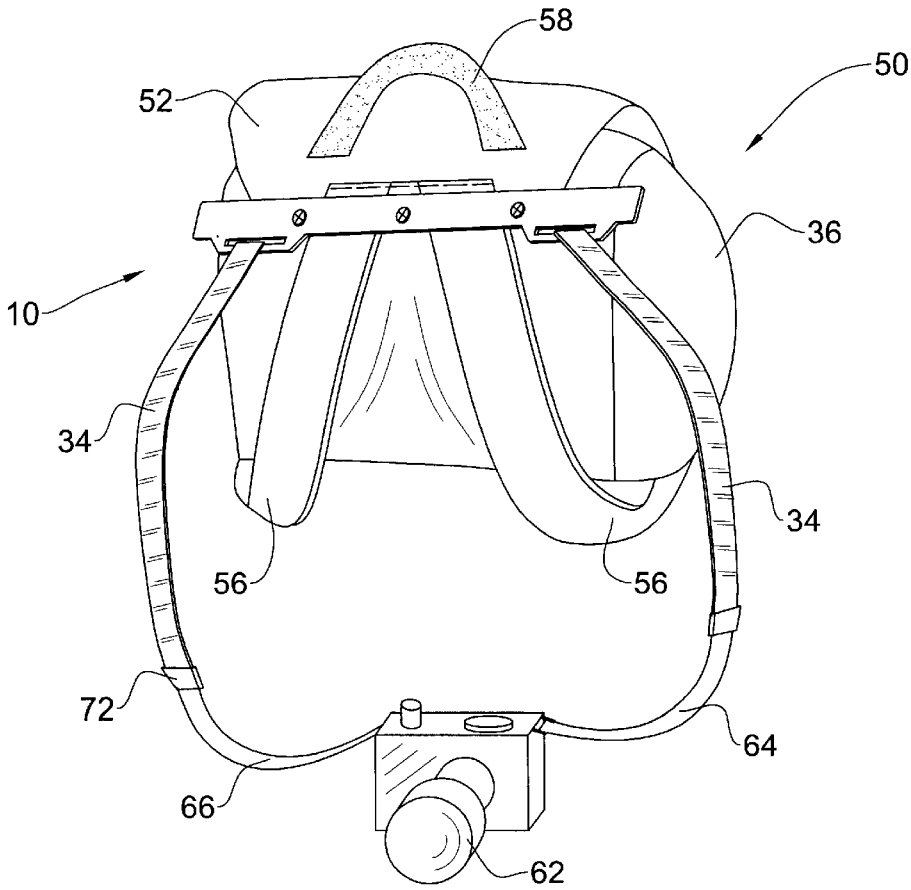
FIG. 2 illustrates a device in accordance with the present invention mounted on a flap-type cover of a backpack and supporting a camera for hanging over an individual's chest.

Turning now also to FIG. 2, device 10 is illustrated in an assembled position in conjunction with a backpack designated 50 of the type comprising a compartment closable by a flap-type top cover 52, a pair of back straps 56 and a carrying handle 58.

Carrying device 10 is clampingly attached to the cover 52 adjacent its hinging portion to the backpack 50, and is secured by the screws/bolts 26 extending through the bores 16 (FIG. 1)

It is noticeable that the cover portion 52 of the backpack 50 is received within the indented portion 32 of the carrying device 10 such that the projecting portions 33 laterally project from the cover 52.

Straps 34 are engaged with the carrying device 10, with a camera 62 being supported thereby.

The arrangement is such that a load, camera 62 in the present case, carried by the individual is in fact supported by back straps 56 without any burden on the individual's neck, making it possible to carry heavier gear for extended periods of time.

In the present example, camera 62 is fitted with two short straps 64 and 66, the former fitted at its free end with a male-component 68 of a quick-release fastener couple adapted for engagement with female-component 40 of strap 34 whilst strap 66 is fitted with a female-component 72 of a quick-release fastener couple adapted for engagement with male-component 38 of strap 34 of device 10. This arrangement enables also connecting male-component 68 and female-component 72 whereby the camera 62 may be used with the straps 64 and 66 when it is not desired to use the carrying device 10.

It is appreciated that in the embodiment of FIG. 2, the screw/bolt 26 of the central bore 20 are removed unless a hole ifs formed in the cover 52 of backpack 50.

Figure 3:
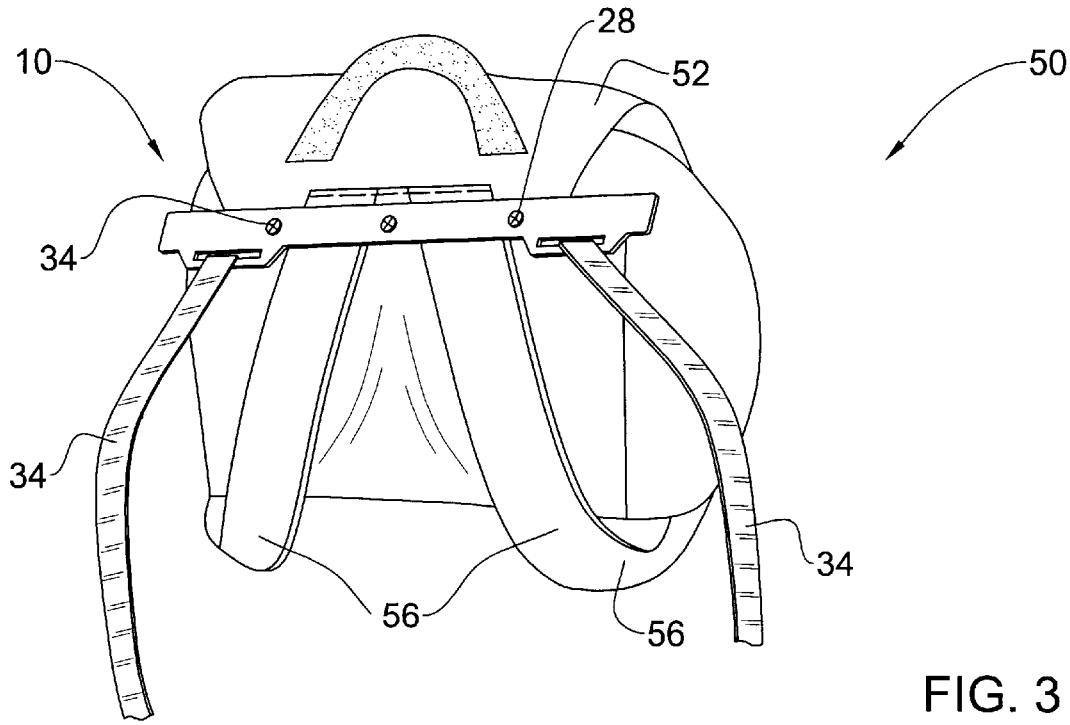
FIG. 3 illustrates the hanging device of FIG. 1 attached to back straps of a backpack.

In the embodiment of FIG. 3 the carrying device 10 is attached to the back straps 56 of backpack 50. In accordance with this arrangement, the two bores 16 and the central bore 20 are occupied by fasteners (screws/bolts 26 and corresponding nuts 28). In accordance with this embodiment the carrying device 10 does not interfere in any way with the flap top cover 52 and even if a heavy load suspends from the device by means of straps 34, the cover 52 may be easily opened.

Figure 4:
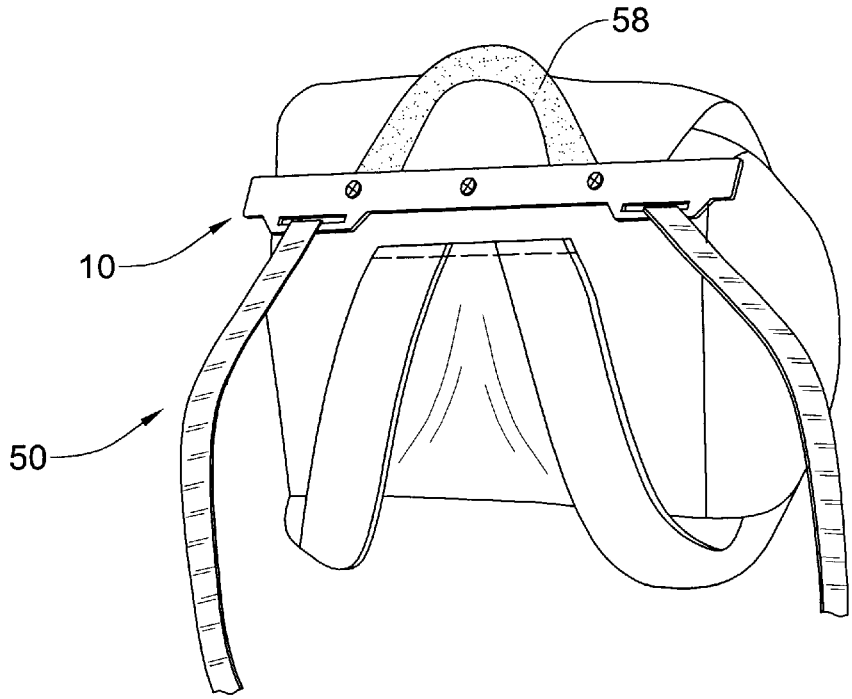
FIG. 4 illustrates the carrying device of FIG. 1 attached to a carrying handle of a backpack.

A similar application is illustrated in FIG. 4 wherein carrying device 10 is articulated to backpack 50 over the carrying handle 58 wherein all bores 16 and 20 are occupied by fasteners (screws/bolts 26 and nuts 28). This arrangement has the same advantages of the previous embodiment. In order to prevent the device 10 from sliding with respect to the carrying handle 58, the additional intermediate center holes 21 may be used.

Figure 5:
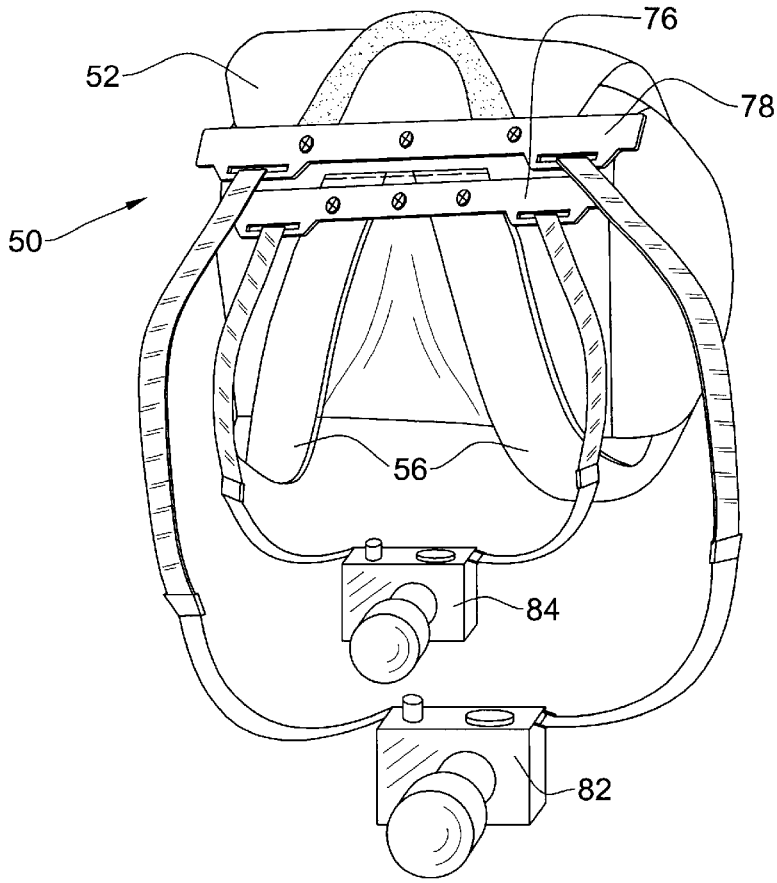
FIG. 5 illustrates a backpack fitted with a first carrying device fitted on a flap-type cover of a backpack and a second carrying device attached to back straps of the backpack.

The embodiment of FIG. 5 illustrates an application combining the embodiments of FIGS. 2 and 3 wherein a first carrying device 76 is clampingly articulated to cover 52 of the backpack, and a second carrying device 78 is articulated to back straps 56. Carrying devices 76 and 78 are similar with those illustrated in the previous embodiments though they may be of different lengths, e.g. carrying device 78 may be slightly shorter than carrying device 76, typically, the distance between strap engaging slits 30 is not less than about 15 cm so as not to interfere with the individual's neck.

It is noted in FIG. 5 that a first camera 82 is suspended from carrying device 76 and a second camera 84 is suspended from the second carrying device 78. It is however understood that a variety of gear may be suspended from the carrying device, e.g. binoculars, range finder, telescope. etc.

Figure 6:
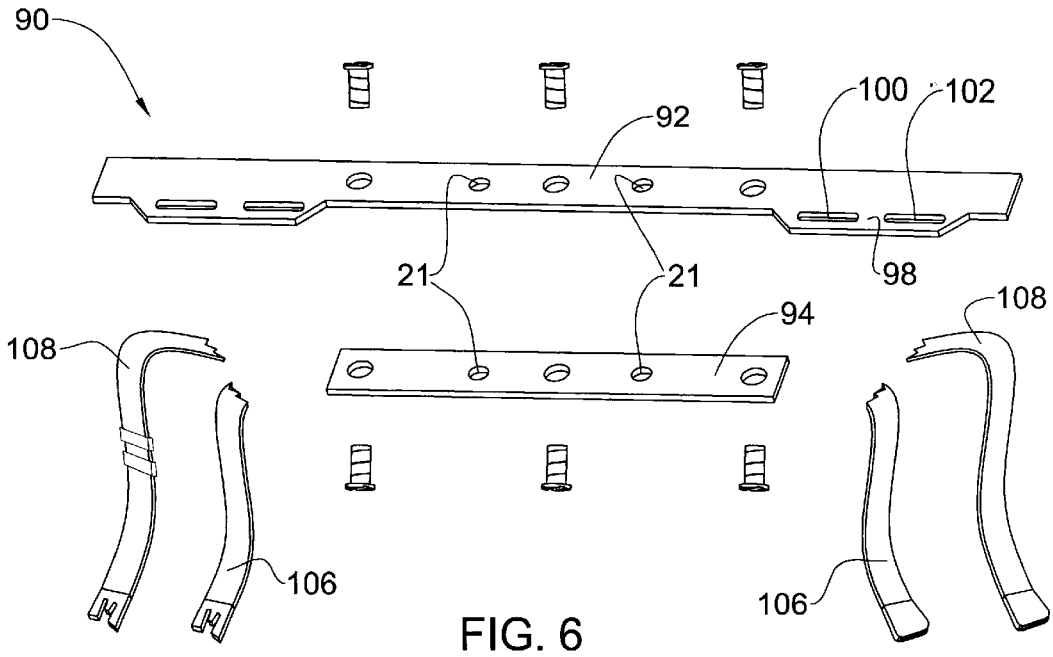
FIG. 6 is an exploded, isometric view of an embodiment of the carrying device in accordance with the present invention.

The embodiment of FIG. 6 illustrates a variation of a carrying device in accordance with the present invention generally designated 90 comprising a yoke member 92 and a clamping member 94. Yoke member 92 is similar to yoke member 12 of FIG. 1 with the exception that the end portions 98 are formed with two strap-engaging slits 100 and 102 for articulating thereto two pairs of straps 106 and 108, respectively.

A further difference in the embodiment of FIG. 6 resides in that the clamping device 94 is merely a flat strip of material for clamping engagement with the yoke member 92, without the end portions or strap-engaging slits 100,102 as in yoke member 92.

The carrying device 90 of FIG. 6 is used in a similar manner as illustrated and explained in connection with a previous embodiment.

Figure 7A:
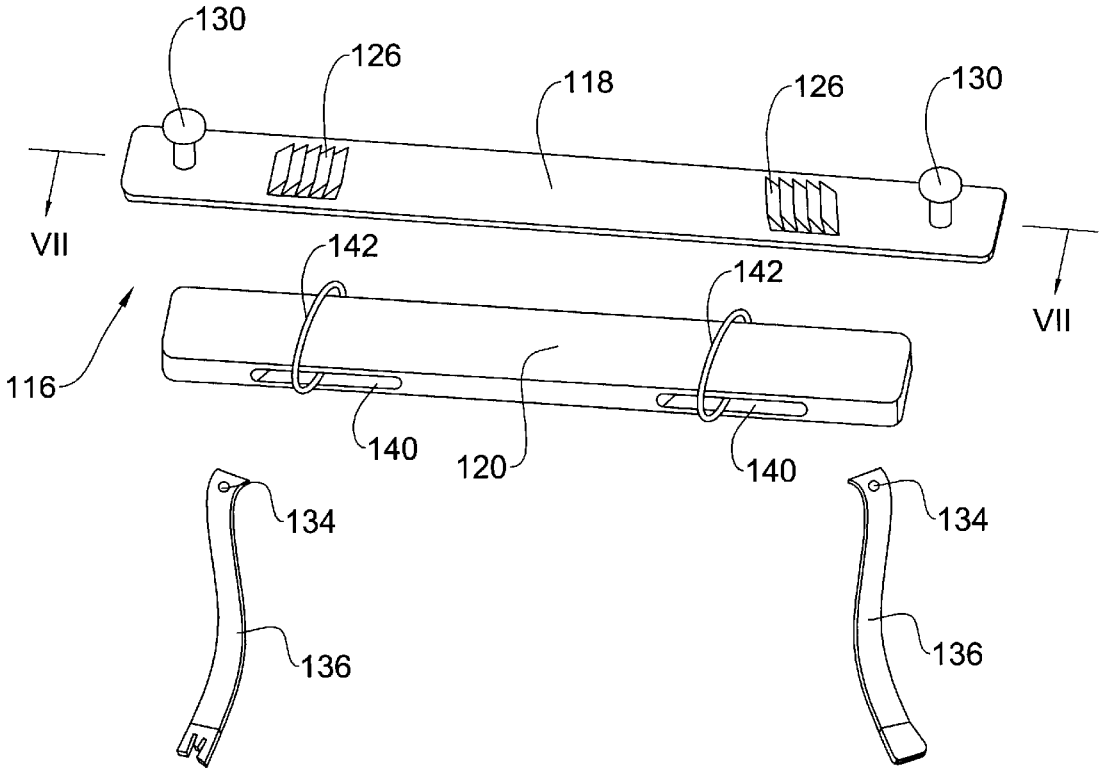
FIG. 7A is an exploded, isometric view of the device.
Figure 7B:
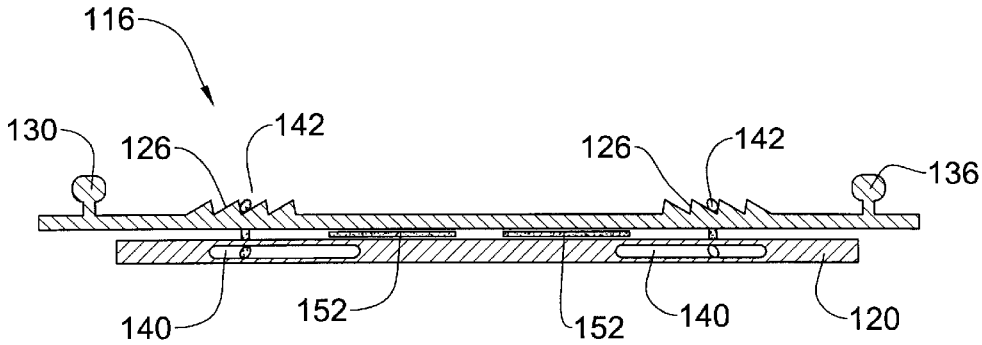
FIG. 7B is a section through the device along line VII—VII in FIG. 7A, in an assembled position.
Figure 1:
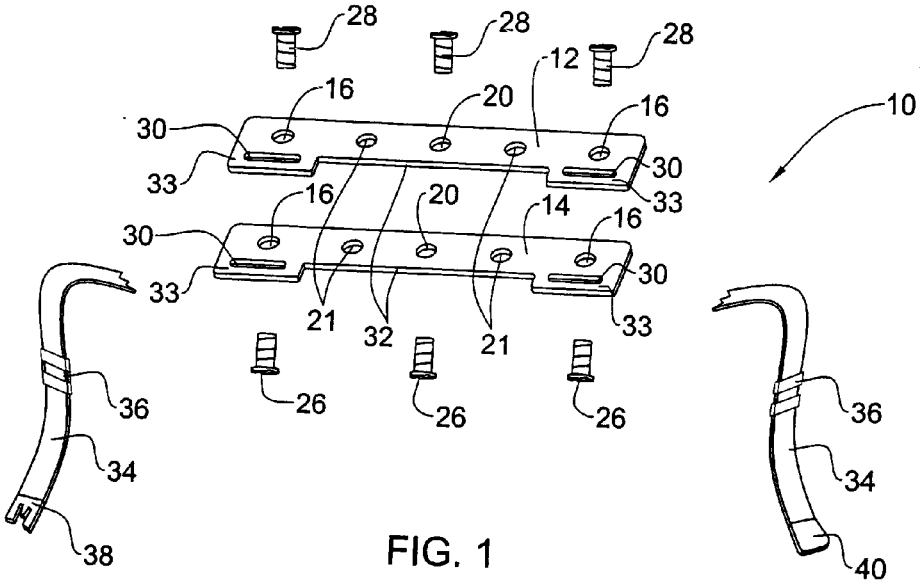
Figure 2:
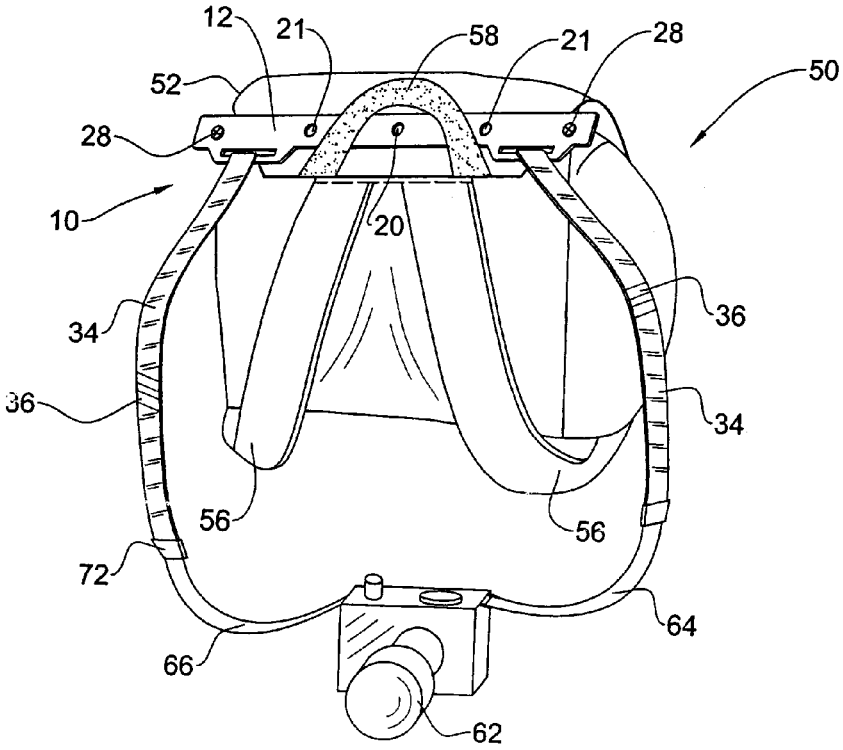
Figure 3:
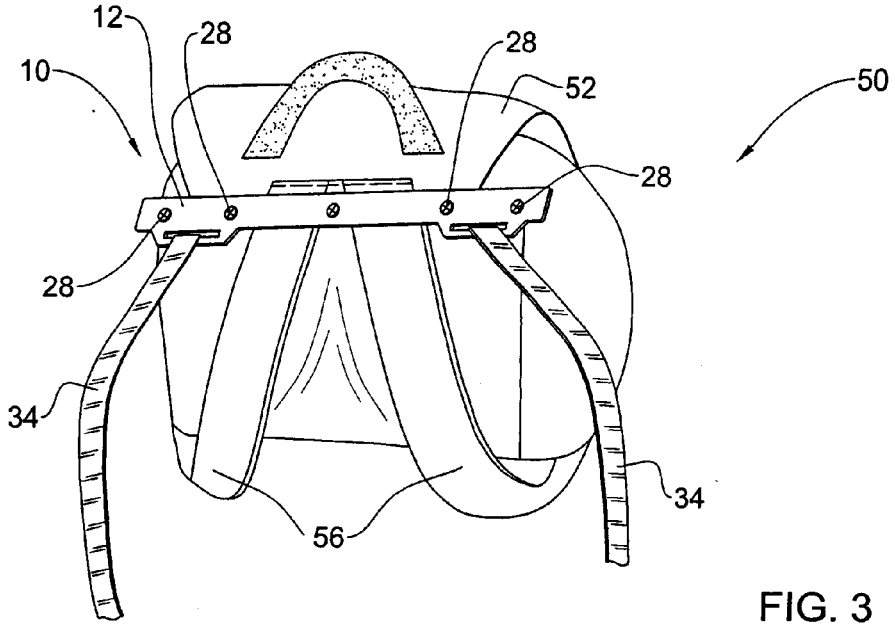
Figure 4:
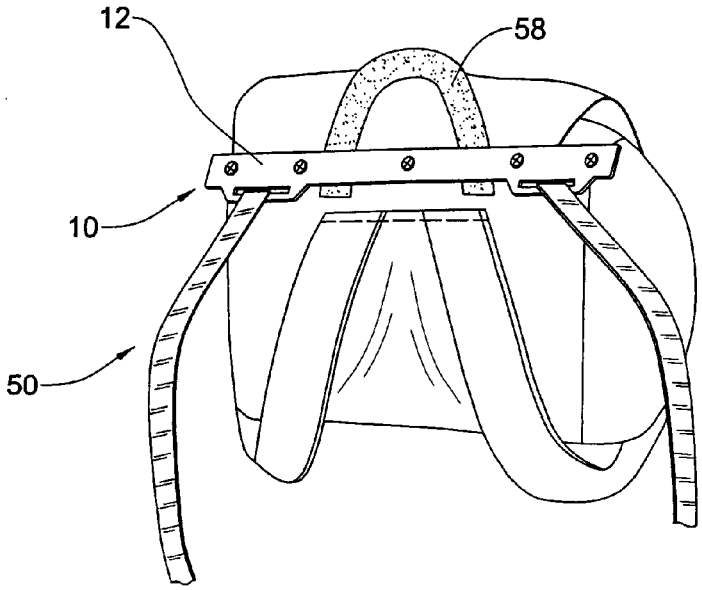
Figure 5:
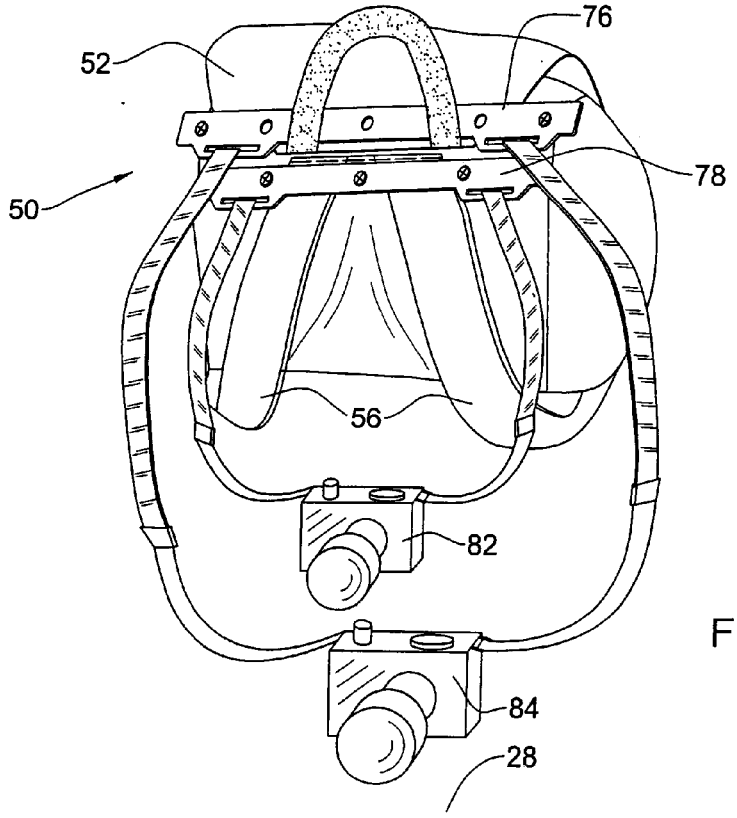
Figure 6:
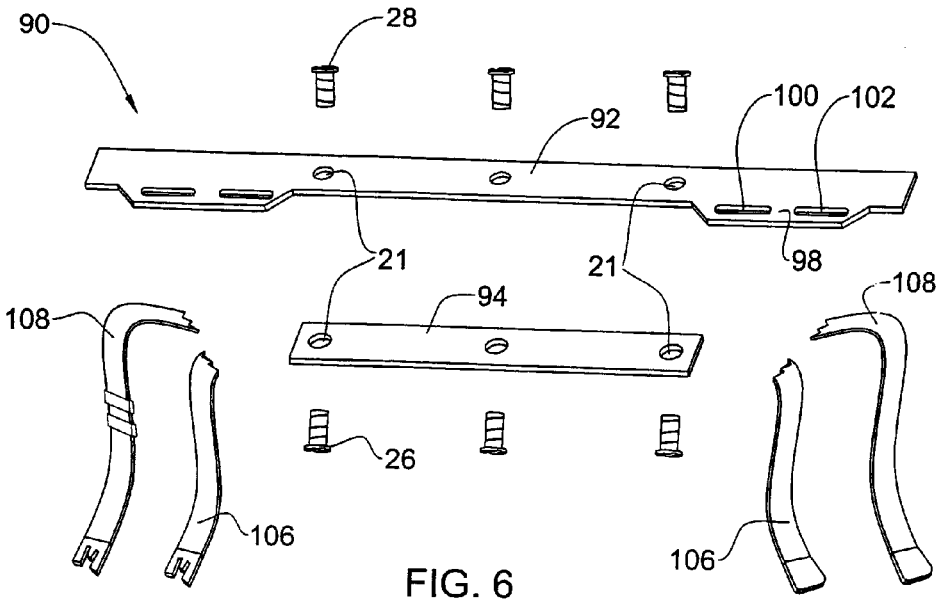
Figure 7A:
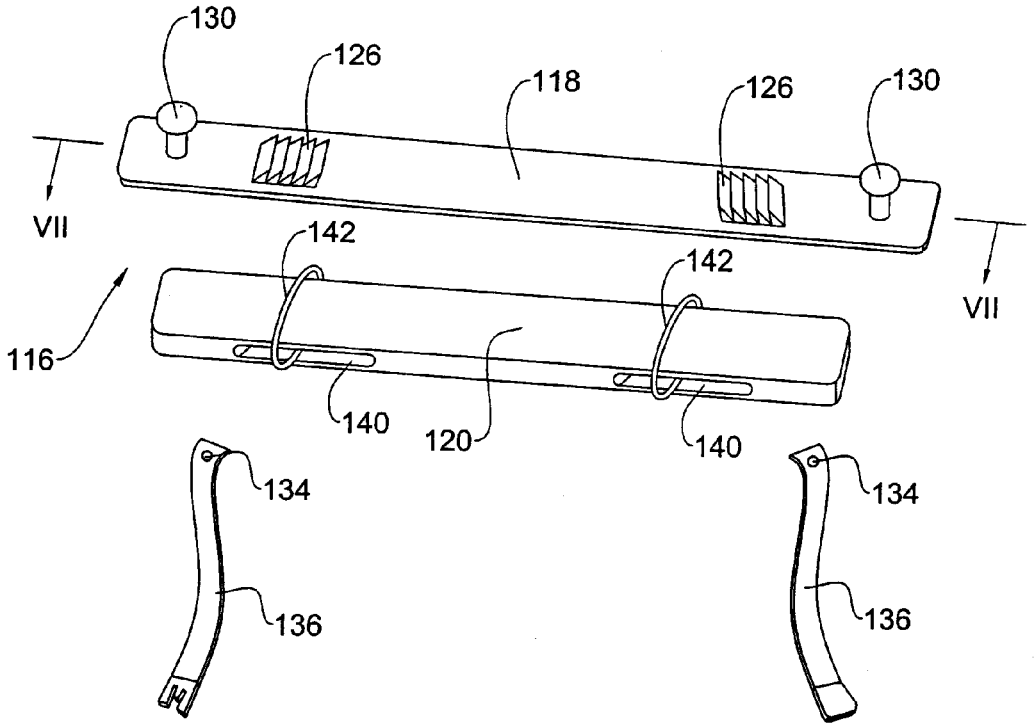
Figure 7B:
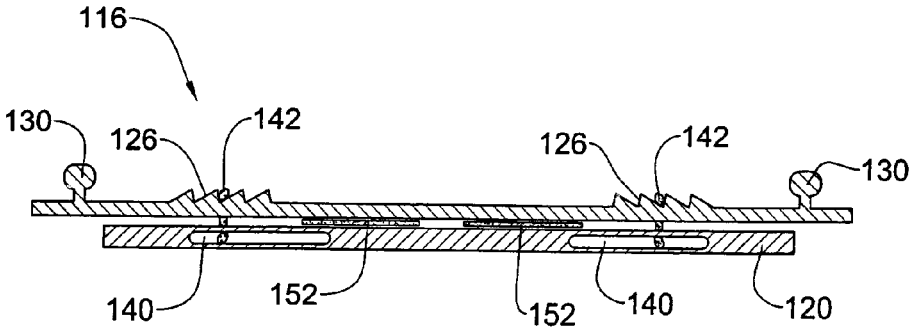

FIGS. 7A and 7B illustrates still another embodiment of the carrying device in accordance with the present invention, generally designed 116 comprising a yoke 118 and a clamping member 120, both made of rigid strip material of suitable length for engagement with a backpack as illustrated in the previous embodiments.

Yoke member 118 is formed with saw-like twist portions 126. Each end of yoke member 118 is formed with strap-engaging bulges 130 engageable with corresponding apertures 134 formed in corresponding straps 136.

Yoke member 120 is formed with two recesses or grooves 140 each slidably accommodating a breach member 142 engagable with twist portion 126 of the yoke member 118, as illustrated in the assembled position of FIG. 7B, clampingly secured over back straps 152 of a backpack (not illustrated). However, this embodiment is in particular useful for attaching the carrying device to a flap-cover and straps.

In order to prevent the gear suspended from the straps to dangle freely, the straps supporting the gear are engageable with the back straps of the backpack. This may be for example by providing a Velcro™ fastener or a hook, etc.

Whilst some embodiments have been described and illustrated with reference to some drawings, the artisan will appreciate that many variations are possible which do not depart from the general scope of the invention, mutatis, mutandis.

What is claimed is:

1. A carrying device for supporting gear in front of an individual's torso, the device comprising an elongate yoke member made of rigid material extending between two ends thereof, and a clamping member adapted for engagement with the yoke member so as to clampingly fix the device on a supportive member of a backpack; and where at least both ends of the yoke member laterally project from said supportive member; and each of said ends is formed with at least one strap-engaging element for connecting thereto a strap to support the gear.

2. A carrying device according to claim 1, wherein the supportive member is one of a top flap-like cover, a carrying handle and a pair of carrying back straps of the backpack.

3. A carrying device according to claim 1, wherein the yoke member spans longer than the neck width of an adult individual.

4. A carrying device according to claim 1, wherein the clamping member and the yoke member are identical.

5. A carrying device according to claim 1, wherein at least the yoke member is formed at each of its ends with at least two strap-engaging slits.

6. A carrying device according to claim 1, wherein one of the yoke member and the clamping member is formed with an indented portion extending at least the span of a flap of a backpack.

7. A carrying device according to claim 6, wherein the length of the indented portion is in the range of between about 15 cm to 30 cm.

8. A carrying device according to claim 1, wherein the yoke member is engaged with the clamping member by at least a pair of fastening members fitted adjacent the ends of the clamping member.

9. A carrying device according to claim 1, wherein the yoke member is engaged with the clamping member by a centrally positioned bolt, whereby the device is configured to be attached to a carrying handle of the backpack.

10. A carrying device according to claim 8, wherein the fastening members are bolts.

11. A carrying device according to claim 8, wherein the fastening members are clamps.

12. A carrying device according to claim 11, wherein the clamps are slidably engageable over the clamping member and the yoke member.

13. A carrying device according to claim 1, wherein at least one strap-engaging element is a slit adapted for receiving the strap.

14. A carrying device according to claim 1, wherein at an assembled position there is a clearance between corresponding surfaces of the yoke member and the clamping member.

15. A carrying device according to claim 1, wherein the gear is photographic and video equipment.

16. A carrying device according to claim 1, wherein the straps are fitted at free ends thereof with a quick release fastener.

17. A carrying system comprising a backpack formed with at least one supportive portion, at least one carrying device according to one of claims 1–14 or 16, and at least two straps associated with each of the at least one carrying device, attached to the strap-engaging element for suspending over the shoulders of the individual and articulating thereto the gear.

18. A carrying system according to claim 17, wherein the gear is photographic and video equipment.

19. A carrying system for supporting gear over an individual's chest, the system comprising a backpack fitted with a pair of back straps; a carrying device comprising a yoke member and a clamping member adapted for engagement with the yoke member so as to clampingly fix the device at a top portion of the back straps; and at least one strap-engaging element at each end of the yoke member for connecting thereto a strap to support the gear.

20. A carrying system according to claim 19, wherein the backpack further comprises at least one of a top flap-like cover and a carrying handle of the backpack and where the carrying device may be clamped also over either one of them.

21. A carrying system according to claim 19, wherein the yoke member spans longer than the neck width of an adult individual.

22. A carrying system for system for supporting gear over an individual's chest, the system comprising a backpack fitted with a pair of back straps, and a carrying device adapted for clamping engagement with a supportive portion of the backpack; said carrying device being fitted with at least a pair of straps dangling over the individuals shoulders, for articulating thereto the gear.

23. A carrying system according to claim 22, wherein the supportive portion of the backpack is one or more of the pair of back straps and a top flap-type cover and a carrying handle.

24. A carrying device for use in conjunction with a backpack, the device comprising an elongate yoke member made of rigid material and a clamping member adapted for engagement with the yoke member so as to clampingly fix the device to a supportive member of the backpack; a strap articulated at two respective ends of the yoke member for attaching thereto gear suspended over an individual's chest while carrying the backpack.

* * * * *

UNITED STATES PATENT AND TRADEMARK OFFICE

CERTIFICATE OF CORRECTION

PATENT NO. : 6,662,984 B2
DATED : December 16, 2003
INVENTOR(S) : Avichay Mor

It is certified that error appears in the above-identified patent and that said Letters Patent is hereby corrected as shown below:

Drawings,
Please replace Figs. 1-6, 7(a) and 7(b) (Sheets 1-4) with the attached new formal drawings of Figs. 1-6, 7(a) and 7(b) (Sheets 1-4).

Signed and Sealed this

Twenty-fourth Day of August, 2004

JON W. DUDAS
*Director of the United States Patent and Trademark Office*